US006227730B1

(12) United States Patent
Yorozu et al.

(10) Patent No.: US 6,227,730 B1
(45) Date of Patent: May 8, 2001

(54) THERMAL TRANSFER PRINTER WITHOUT PRINTING DISPLACEMENT

(75) Inventors: Hideki Yorozu; Yuusai Ishitobi; Hideo Kawase, all of Iwate-ken (JP)

(73) Assignee: Alps Electric Co., Ltd. (JP)

( * ) Notice: Subject to any disclaimer, the term of this patent is extended or adjusted under 35 U.S.C. 154(b) by 0 days.

(21) Appl. No.: 09/409,786

(22) Filed: Sep. 30, 1999

(30) Foreign Application Priority Data

Oct. 2, 1998 (JP) ..... 10-281134

(51) Int. Cl.[7] ..... B41J 2/315
(52) U.S. Cl. ..... 400/120.01; 400/124.02
(58) Field of Search ..... 400/120.01, 120.13, 400/124.03, 120.11, 120.12, 124.02, 118.3, 124.16

(56) References Cited

U.S. PATENT DOCUMENTS 4,741,634 * 5/1988 Nozaki et al. ..... 400/120
5,153,605 * 10/1992 Ohara et al. ..... 346/76
5,708,762 * 1/1998 Chiba et al. ..... 395/108
5,860,751 * 1/1999 Osgasawara ..... 400/206
5,876,129 * 2/1999 Suzuki ..... 400/120.01
5,971,634 * 10/1999 Buckby et al. ..... 400/120.01
6,045,275 * 4/2000 Hosoya ..... 400/120.01

FOREIGN PATENT DOCUMENTS 9-94994 4/1997 (JP) .

* cited by examiner

*Primary Examiner*—John S. Hilten
*Assistant Examiner*—Davis M. Cone
(74) *Attorney, Agent, or Firm*—Brinks Hofer Gilson & Lione

(57) ABSTRACT

The invention intends to obtain a good printed result without creating displacement of printing positions when printing is performed on a piece of printed paper with different contact pressures of the thermal head to the platen. To achieve the object, the thermal transfer printer of the invention comprises control means that make it possible to select a contact pressure of the thermal head to the platen in correspondence with a printing mode, and controls a printing setting position in accordance with the printing mode selected, whereby it becomes possible to correct the drifts of printing positions due to the difference of contact pressures of the thermal head to the platen, and acquire an excellent printed result without having the drifts of printing positions.

2 Claims, 8 Drawing Sheets

FIG. 2

| PRINTING MODE | VERTICAL DIRECTION | | |
|---|---|---|---|
| | A | B | C |
| HIGH CONTACT PRESSURE (THERMALLY FUSED INK) | ○ | ○ | ○ |
| INTERMEDIATE CONTACT PRESSURE (METALLIC INK) | | ↕ | ↕ |
| LOW CONTACT PRESSURE (THERMALLY SUBLIMED INK) | | | ○ |

| PRINTING MODE | | HIGH CONTACT PRESSURE (THERMALLY FUSED INK) | INTERMEDIATE CONTACT PRESSURE (METALLIC INK) | LOW CONTACT PRESSURE (THERMALLY SUBLIMED INK) |
|---|---|---|---|---|
| LATERAL DIRECTION | A | ○ | | |
| | B | ○ ↔ | ○ | |
| | C | ○ ↔ | | ○ |

PRINTING WITH INTERMEDIATE CONTACT PRESSURE AFTER PRINTING WITH HIGH CONTACT PRESSURE

PRINTING WITH HIGH CONTACT PRESSURE AFTER PRINTING WITH INTERMEDIATE CONTACT PRESSURE

THERMAL TRANSFER PRINTER WITHOUT PRINTING DISPLACEMENT

BACKGROUND OF THE INVENTION

1. Field of the Invention

The present invention relates to a thermal transfer printer, specifically to a thermal transfer printer that acquires an appropriate contact pressure of the thermal head in correspondence with a printing mode, and produces a good printed image without making printing displacement when printing on a printed medium in different printing modes.

2. Description of the Prior Art

Generally, the thermal transfer printer, pressing a thermal head onto a platen through an ink ribbon and a printed medium such as a printed paper and moving a carriage along the platen, drives a heating element of the thermal head selectively on the basis of printing data, and transfers ink of the ink ribbon onto the printed medium, thus performing printing of a desired image. And, such a thermal transfer printer has been widely employed as an output device for computers or word processors because of its high quality of printed images, low noise, low cost, easiness of maintenance, etc.

FIG. 3 and FIG. 4 illustrate major parts of a thermal transfer printer in general. FIG. 3 is a perspective view of a carriage, and FIG. 4 is a plan view of the drive system of the carriage in FIG. 3.

In FIG. 3 and FIG. 4, on a carriage 5 capable of freely reciprocating along a platen 2 is disposed a motor 14 that drives a mechanism for contacting and detaching a thermal head 6 with a plurality of thermal elements arrayed (not illustrated) to and from the platen 2 and a mechanism for taking up an ink ribbon. A pinion 15 on the output of the motor 14 is engaged with a transfer gear 16. The transfer gear 16 is engaged with a gear 18 formed on the circumference of a cam 17. On the upper side of the cam 17 is formed a cam groove 19 for contacting and detaching the head, and on the lower side thereof is formed a cam groove 20 for taking up the ribbon.

And, a vertical support shaft 21 is installed on the carriage 5 near the platen 2. A substantially T-letter shaped head lever 22 constituting the mechanism for contacting and detaching the head is attached to the support shaft 21 so as to freely swing, serving the support shaft 21 as the fulcrum. A head mount 23 facing to the platen 2 is fastened on a part of the head lever 22 near the platen 2. The thermal head 6 is mounted on a plane of the head mount 23 facing to the platen 2, and a stopper 24 is projected on the head mount 23 with a specific distance from the rear side of the head mount 23.

Further, a head pressing lever 25 of substantially L-letter shape is attached to the support shaft 21 so as to freely rock, serving the support shaft 21 as the fulcrum. On one end of the head pressing lever 25, a pin 26 is projected which is engaged in the cam groove 19 of the cam 17 for contacting and detaching the head. The other end of the head pressing lever 25 is located between the rear side of the head mount 23 on the head lever 22 and the stopper 24, and a spring holding part 27 is formed upright on the other end of the head pressing lever 25. Further, a high contact pressure spring 28 is intervened between the spring holding part 27 and the head mount 23. The energizing force of this high contact pressure spring 28 maintains a state that the head pressing lever 25 is in contact with the stopper 24 on the head lever 22. In this state, the head pressing lever 25 and the head lever 22 are integrally swung by the rotation of the cam 17.

And, the carriage 5 includes a drive gear 30 that is able to freely rotate with the support shaft 31 as the rotation center, which is engaged with a rack 29 formed on the main body of the printer not illustrated. A low contact pressure spring 32 having a lower spring pressure than the high contact pressure spring 28 is bridged between the support shaft 31 and the head lever 22, so as to constantly give to the head lever 22 an energizing force that presses the thermal head 6 toward the platen 2.

Further, the support shaft 31 has a swing plate 33 attached thereon, which is able to freely swing with the support shaft 31 as the fulcrum. A pin 34 is projected on one end of this swing plate 33, which is engaged in the cam groove 20 for taking up the ribbon formed on the lower side of the cam 17. A support shaft 35 is projected on the other end of the swing plate 33, and a transfer gear 36 engaged with the drive gear 30 is attached to this support shaft 35 to freely rotate.

Furthermore, a take-up bobbin 7 and a supply bobbin 8 for the ink ribbon are provided on the carriage 5. As shown in FIG. 4, a take-up gear 37 engaged with the transfer gear 36 is coaxially attached on the lower side of the take-up bobbin 7 through a friction mechanism not illustrate d. And, a second take-up bobbin 38 and a second supply bobbin 39 are provided on the carriage 5. A second take-up gear 41 is coaxially attached on the lower side of the second take-up bobbin 38 through a friction mechanism not illustrated, which is engaged through a transfer gear 40 with the take-up gear 37 on the take-up bobbin 7. The take-up bobbin 7 and the second take-up bobbin 38 are each driven to rotate by the engagement of the transfer gear 36 with the take-up gear 37, which is effected by the swing of the swing plate 33. And, the second supply bobbin 39 is installed on the carriage 5 through a friction mechanism not illustrated.

Further, as shown in FIG. 5, a first cam position 19*a*, a second cam position 19*b*, a third cam position 19*c*, and a fourth cam position 19*d* are formed in the cam groove 19 of the cam 17 for contacting and detaching the head, in such a manner that the radii from the rotation center of these cam positions 19*a*, 19*b*, 19*c*, 19*d* are each made into different dimensions r1, r2, r3, r4 within specific ranges of rotation angle. The curve of the cam is formed flat and parallel in each range of the cam positions 19*a* to 19*d*,as shown in FIG. 6.

And, by controlling the rotation of the motor 14 in correspondence with the printing mode such as the printing using the thermally fused ink ribbon, the printing using the metallic ink ribbon, or the printing using the thermally sublimed ink ribbon, the rotation angle of the cam 17 is controlled, the cam positions of the cam groove 19 for contacting and detaching the head that the pin 26 on the head pressing lever 25 is engaged with are selected, and thereby the thermal head 6 is made to give an appropriate contact pressure to the platen 2.

That is, the fourth cam position 19*d* in the cam groove 19 for contacting and detaching the head is the head-up position where the thermal head 6 is detached from the platen 2, the third cam position 19*c* is the low contact pressure position where the printing is made with the lowest contact pressure, the first cam position 19*a* is the high contact pressure position where the printing is made with the highest contact pressure, and the second cam position 19*b* is the intermediate contact pressure position where the printing is made with the intermediate contact pressure between the highest and the lowest. And, in the printing mode using the thermally sublimed ink ribbon, the low contact pressure position is selected, where the pin 26 on the head pressing lever 25 is located at the third cam position 19*c* in the cam groove 19 for contacting and detaching the head; in the printing mode using the metallic ink ribbon, the intermediate contact pressure position is selected, where the pin 26 on the head pressing lever 25 is located at the second cam position 19*b* in the cam groove 19; and in the printing mode using the thermally fused ink ribbon, the high contact pressure position is selected, where the pin 26 on the head pressing lever 25 is located at the first cam position 19*a* in the cam groove 19, where the thermal head 6 is given the highest contact pressure.

Furthermore, a ribbon cassette 44 is mounted on the upper side of the carriage 5, which houses a long ink ribbon 43 and guides the intermediate part of the ink ribbon 43 toward the thermal head 6. This ribbon cassette 44 has a take-up reel and a supply reel not illustrated rotatably installed therein, which are engaged with the take-up bobbin 7 and the supply bobbin 8, respectively, when the ribbon cassette 44 is mounted on the carriage 5. And, the ribbon cassette 44 has a pair of pinch rollers not illustrated installed therein, which are engaged with the second take-up bobbin 38 and the second supply bobbin 39, respectively. Further, the ribbon cassette 44 has a recess 45 formed near the platen 2 on the center thereof, in which the thermal head 6 is inserted; and it has substantially U-letter shaped cutout parts 46, 46 formed on both sides of this recess 45.

As the ink ribbon contained in the ribbon cassette 44, the following types are available: the thermally fused ink ribbon having colored ink layers of the thermally fused yellow, cyan, magenta, and black; the metallic ink ribbon having metallic luster; the thermally sublimed ink ribbon with the thermally sublimed colored ink layers applied thereon; and the ink ribbon having the thermally fused transparent ink layers that are used for undercoat printing or overcoat printing. The type of the ink ribbon 43 is designed to be detected by a selection switch (not illustrated) on the carriage 5 detecting a detection hole formed on the ribbon cassette 44.

Further, as shown in FIG. 7, control means 50 are installed at a specific position on the main body of the printer, which controls the operations of the thermal head 6, head contacting & detaching mechanism, ribbon traveling mechanism, paper feeding mechanism, etc., of this thermal transfer printer 1. The control unit 50 includes a CPU 51, a memory 52 configured with a ROM 52*a* and a RAM 52*b* having appropriate capacities, etc., and a controller 53 that controls to drive the foregoing mechanisms of the thermal transfer printer.

The memory 52 stores at least the printing information as the printing data and outputs the printing data to the controller 53, and this controller 53 selectively drives the heating elements of the thermal head 6 in accordance with the printing data.

Further, the memory 52 stores a program that controls the following operations: the current carrying control to the heating elements of the thermal head 6 at least during printing on the basis of the printing data; the contacting and detaching operation of the thermal head 6 to the platen 2; the drive control of the carriage 5; and the carrying operation of a printed paper by the paper feeding mechanism, etc.

The thermal transfer printer thus constructed, receiving printing information from an external device such as a computer not illustrated, performs printing on the basis of printing information.

Further, as mentioned above, if printing is executed using the normal thermally fused ink ribbon, the thermal head will be pressed to the platen with the highest contact pressure. If executed using the thermally sublimed ink ribbon, the thermal head will be pressed with the lowest contact pressure. And, if executed using the metallic ink ribbon, the printing will be executed with the intermediate contact pressure between the former two. Further, the contact pressures of the thermal head to the platen are selected by controlling the rotational positions of the cam 17.

And, there is a case that requires printing with different contact pressures of the thermal head to the platen on a piece of printed paper, for example, printing with the thermally fused ink ribbon and the metallic ink ribbon, printing with the thermally sublimed ink ribbon and the metallic ink ribbon, or the like.

However, when printing is conducted with different contact pressures on a piece of printed paper, that is, when after printing is conducted with a high contact pressure, printing with a low contact pressure is overlapped at the same printing position, or when after printing with a low contact pressure, printing with a high contact pressure is overlapped at the same printing position, the printing position is displaced in the paper feeding direction, because the printing position during the head pressed down is dislocated downward in printing with a low contract pressure in comparison to printing with a high contact pressure, or the printing position during the head pressed down is dislocated upward in printing with a high contract pressure in comparison to printing with a low contact pressure. The printed results in these two cases become inadequate in quality, as shown in FIG. 8A and FIG. 8B.

FIG. 8A illustrates printing with the intermediate contact pressure after printing with the high contact pressure, in which the subsequent printing with the intermediate contact pressure is dislocated in the feeding direction of printed paper, namely, in the printing direction, against the preceding printing with the high contact pressure. On the other hand, FIG. 8B illustrates printing with the high contact pressure after printing with the intermediate contact pressure, in which the subsequent printing with the high contact pressure is dislocated in the opposite direction to the feeding direction of printed paper, against the preceding printing with the intermediate contact pressure.

Furthermore, when printing with a low contact pressure is overlapped at the same printing position after printing with a high contact pressure, or when printing with a high contact pressure is overlapped at the same printing position after printing with a low contact pressure, the printing position is displaced in the lateral direction, namely, in the moving direction of the thermal head, because the transfer position of the ink ribbon during the head pressed down is displaced more significantly in the direction of shifting in printing with a high contract pressure than in printing with a low contact pressure, on the other hand, the transfer position of the ink ribbon during the head pressed down is displaced less significantly in the direction of column in printing with a low contract pressure than in printing with a high contact pressure. The printed result becomes inadequate in quality, as shown in FIG. 9, which is a problem to be resolved.

SUMMARY OF THE INVENTION

It is an object of the present invention to provide a thermal transfer printer that produces a good printed result without creating printing displacement, when printing is performed on a piece of printed paper in different printing modes, with different contact pressures of the thermal head to the platen.

In order to accomplish the object, the thermal transfer printer of the present invention possesses control means that make it possible to select a contact pressure of the thermal head to the platen in correspondence with a printing mode, and controls a printing setting position in accordance with the printing mode selected.

Further, the control means are configured to control the printing setting position by controlling a position where a printed medium is set and a position where current-carrying to the thermal head is started.

Furthermore,the control means are configured to control the printing setting position by controlling a dummy dot space when the printing data is expanded into images.

The application of these configurations will correct a drift of the printing position resulting from a difference of the contact pressures to thereby produce an excellent printed result without drifts of printing positions.

BRIEF DESCRIPTION OF THE DRAWINGS

FIG. 2 is a chart to typically explain vertical and lateral drifts in the printing modes of the thermal transfer printer, which are corrected by the embodiment shown in FIG. 1;

DETAILED DESCRIPTION OF THE PREFERRED EMBODIMENTS

Figure 7:
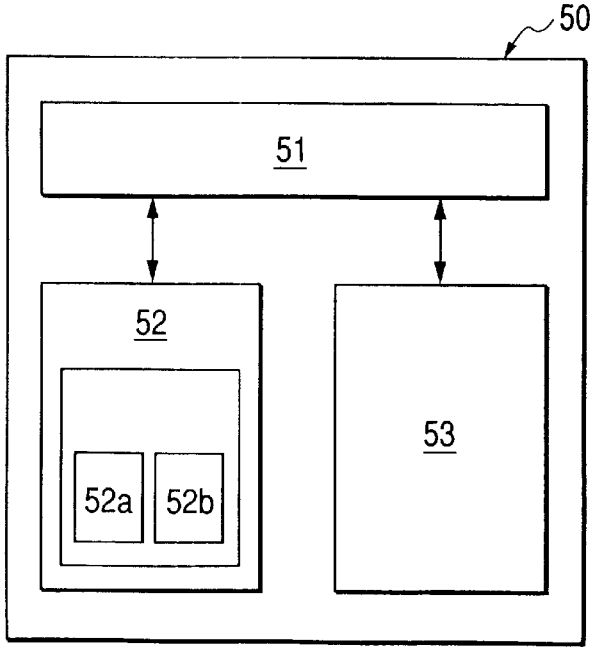
FIG. 7 PRIOR ART
FIG. 7 is a block diagram to illustrate a configuration of control means in the conventional thermal transfer printer.
Figure 8A:
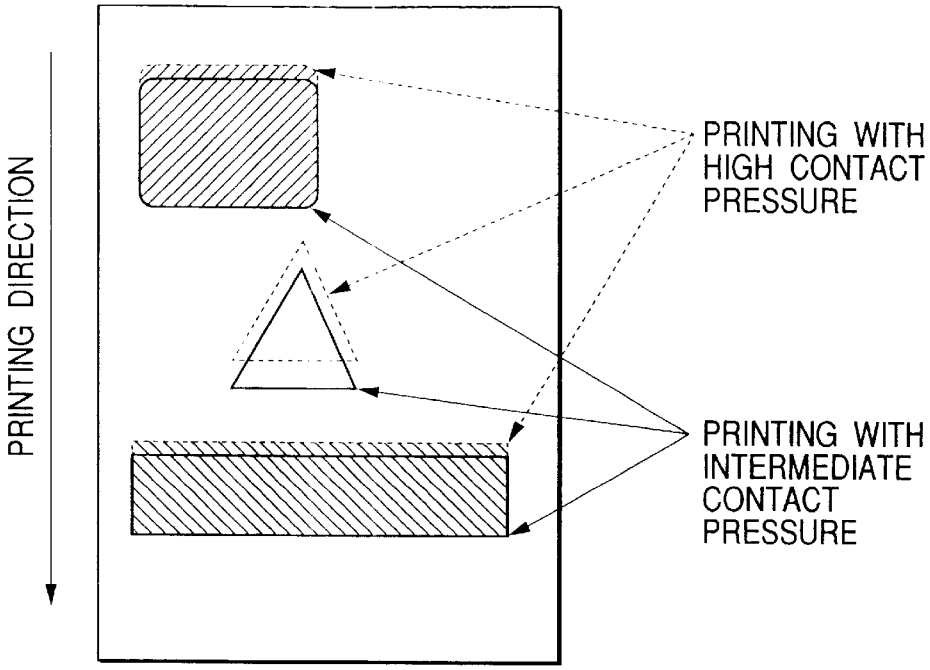
FIG. 8A PRIOR ART
FIG. 8A and FIG. 8B are charts to explain the vertical drifts of the printing positions each resulting from a difference of contact pressures to the head in the conventional thermal transfer printer.
Figure 8B:
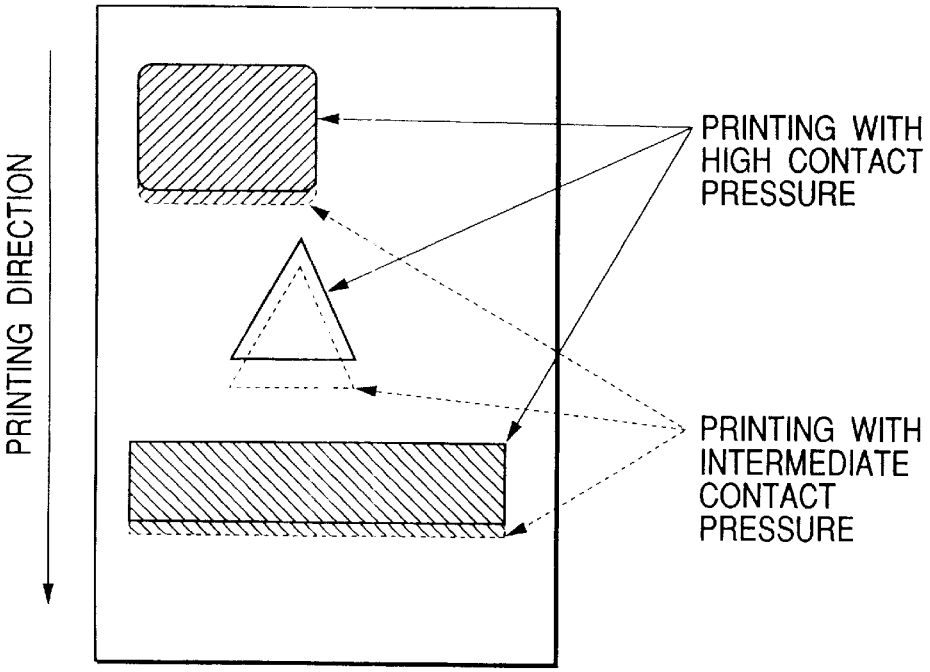
FIG. 8B PRIOR ART
Figure 9:
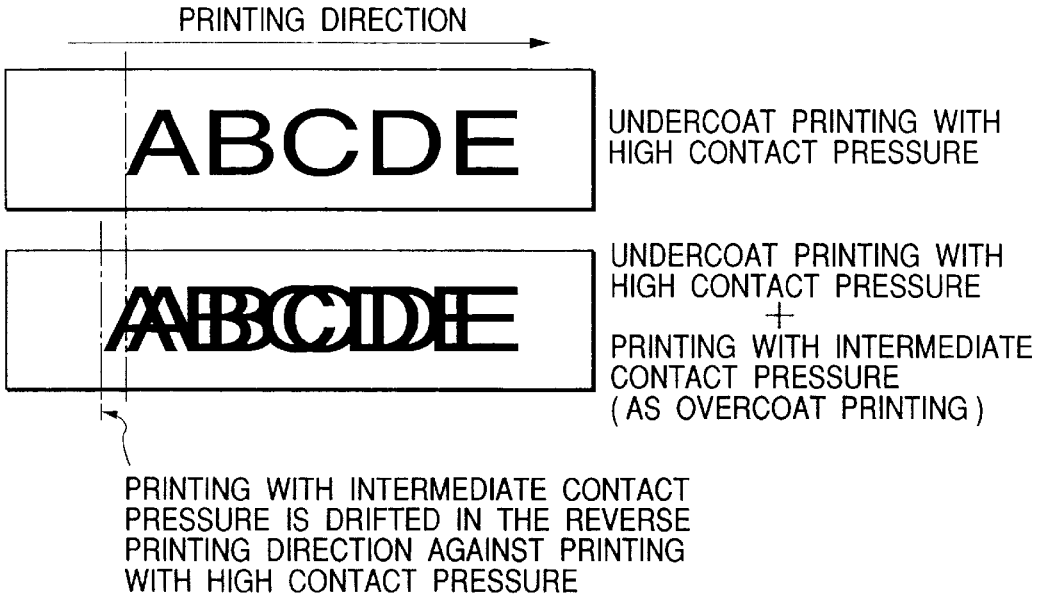
FIG. 9 PRIOR ART
FIG. 9 is a chart to explain the lateral drift of the printing position resulting from a difference of contact pressures to the head in the conventional thermal transfer printer.

The thermal transfer printer of this embodiment is the same as the conventional one in terms of the constructions shown in FIG. 3 through FIG. 6. The difference lies in that the control unit shown in FIG. 7 is changed in this embodiment. Accordingly, the constructions shown in FIG. 3 through FIG. 6 which are common to both, are given the same symbols for explanation.

Figure 1:
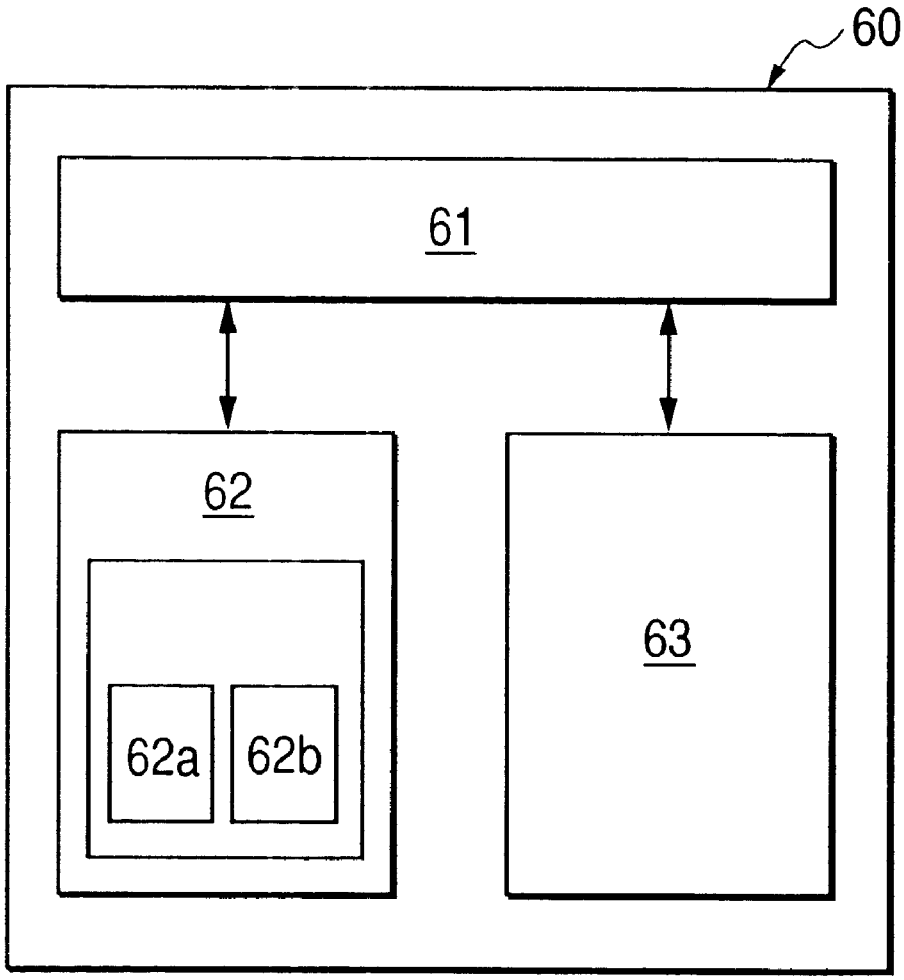
FIG. 1 is a block diagram to illustrate a configuration of control means based on an embodiment of the thermal transfer printer relating to the present invention.
Figure 3:
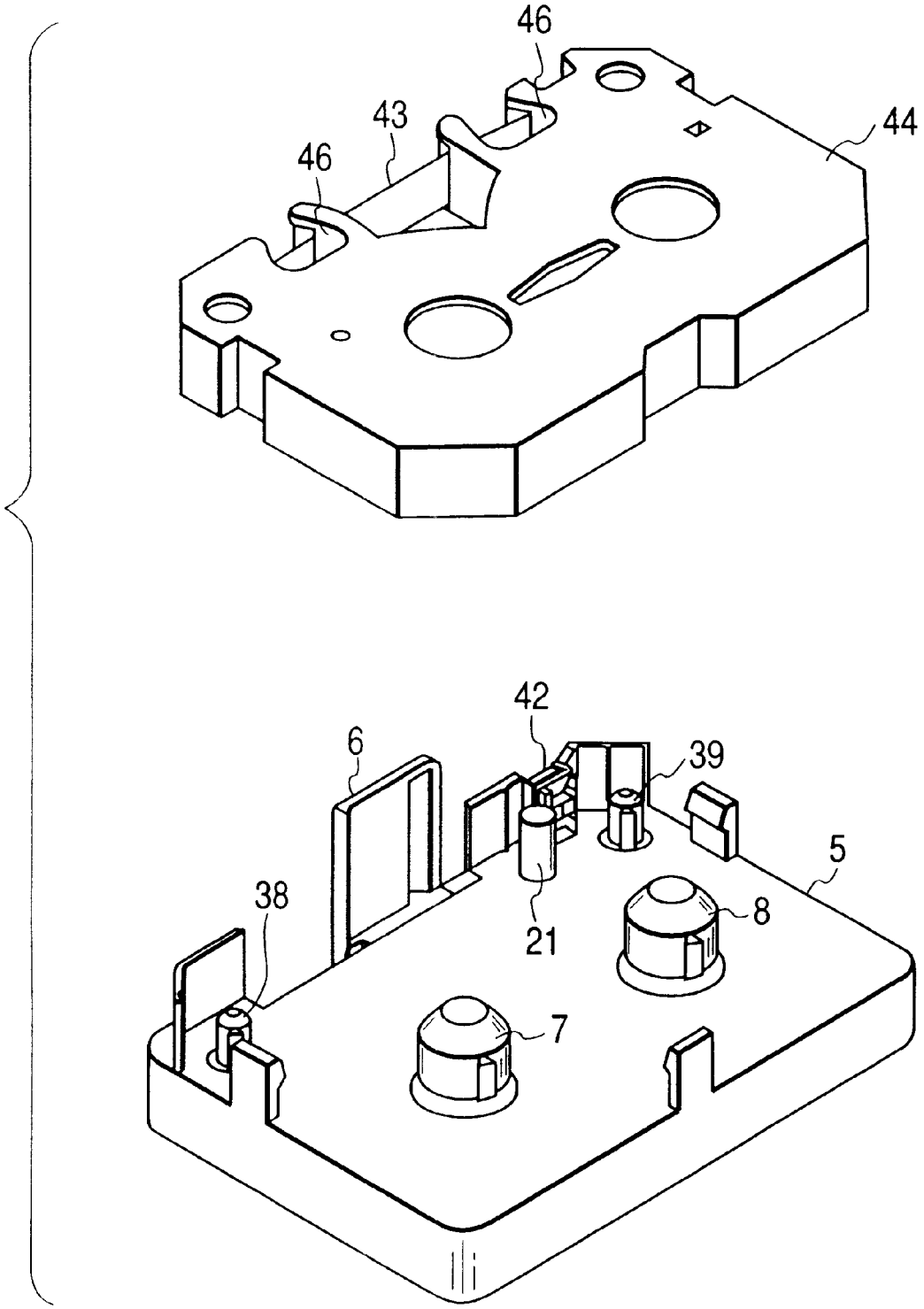
FIG. 3 is a perspective view to illustrate a carriage of the thermal transfer printer, which is adopted commonly to the conventional thermal transfer printer and the embodiment.
Figure 4:
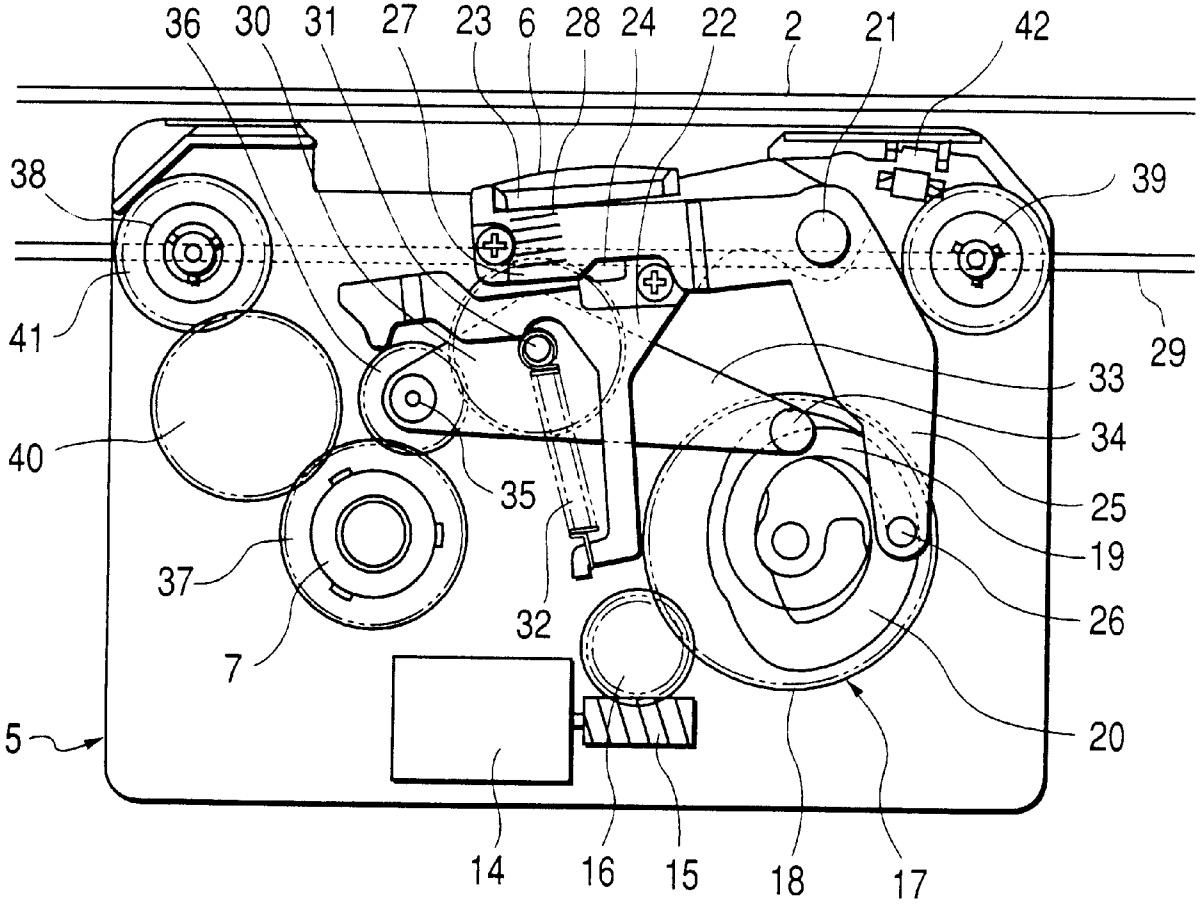
FIG. 4 is a plan view to illustrate the drive system for the carriage shown in FIG. 3.
Figure 5:
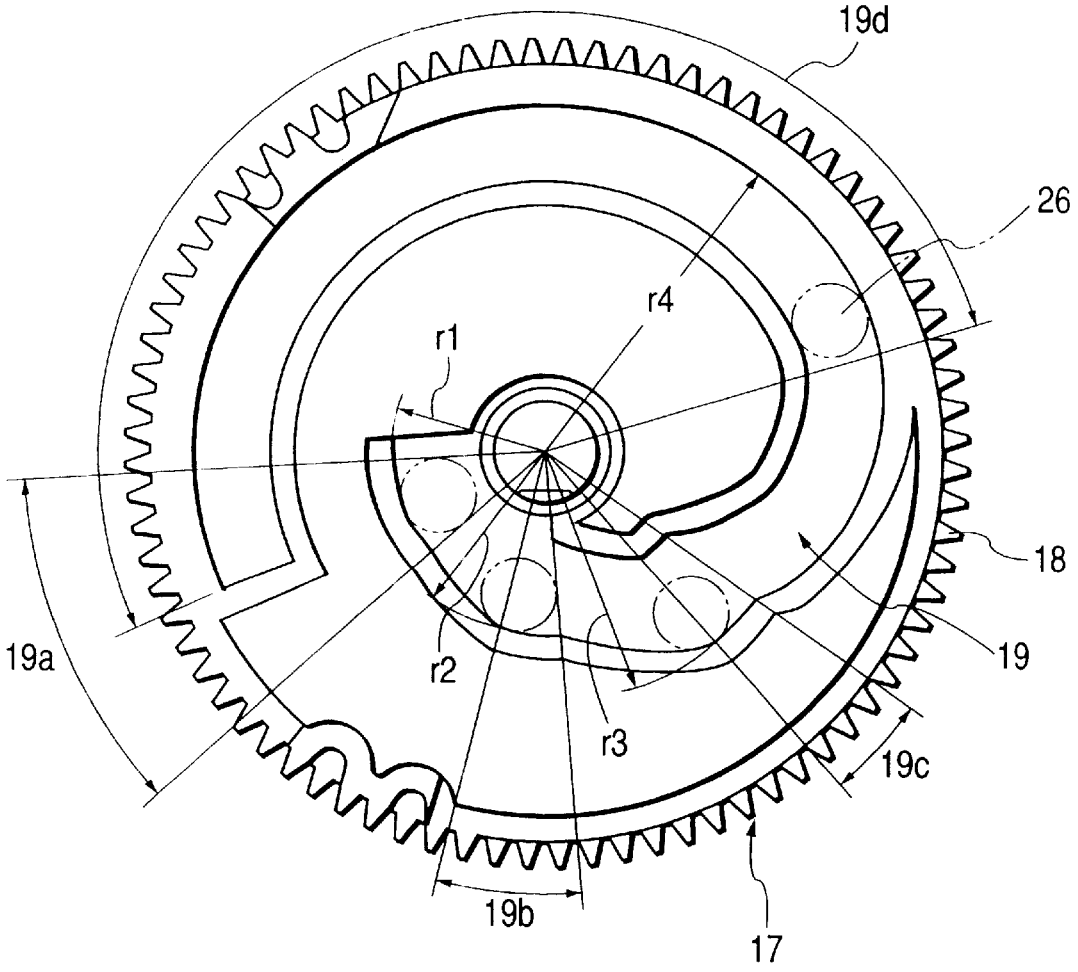
FIG. 5 is a plan view to explain the construction of a cam for the drive system shown in FIG. 4
Figure 6:
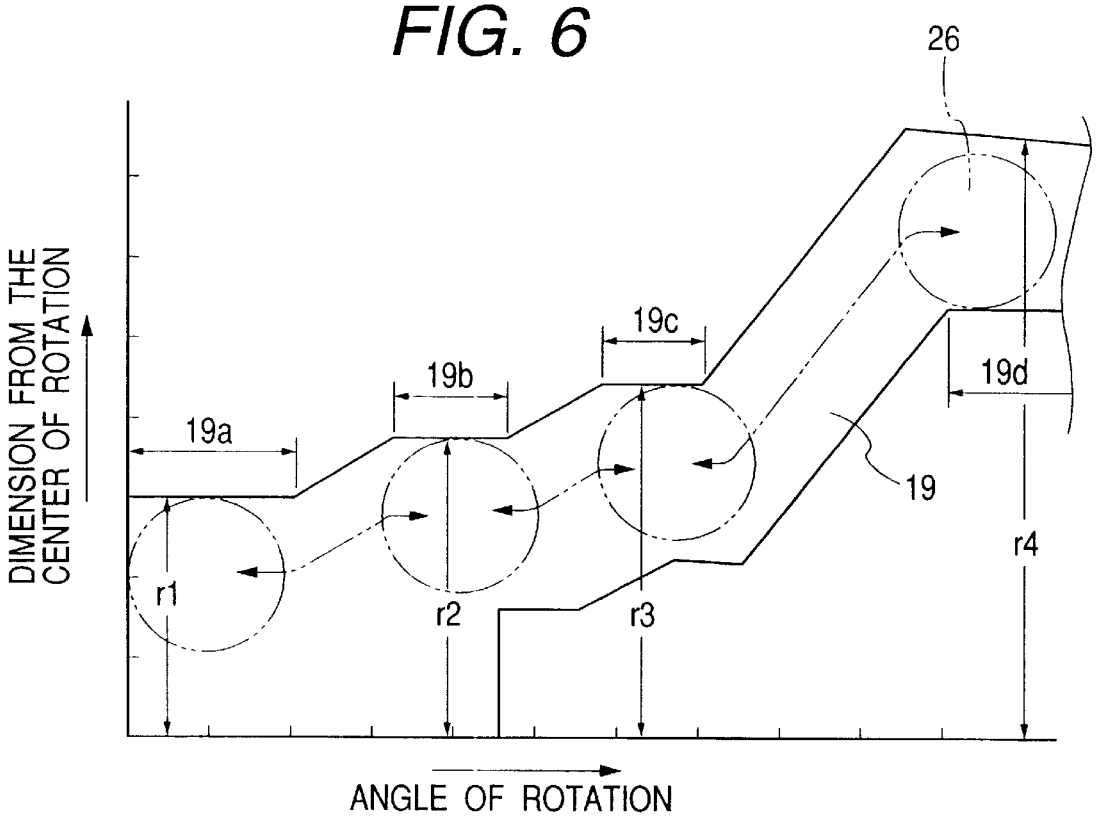
FIG. 6 is a chart to explain the curve of a cam groove of the cam shown in FIG. 5.

FIG. 1 illustrates the control means for the thermal transfer printer in this embodiment. This control means 60 are designed to control the operations of the thermal head 6, head contacting & detaching mechanism, ribbon traveling mechanism, paper feeding mechanism, etc., of this thermal transfer printer 1. The control means 60 possess at least a CPU 61, a memory 62 configured with a ROM 62*a* and a RAM 62*b* having appropriate capacities, etc., and a controller 63 that controls to drive the foregoing mechanisms of the thermal transfer printer.

The memory 62 stores at least the printing information as the printing data and outputs the printing data to the controller 63, and this controller 63 selectively drives the heating elements of the thermal head 6 in accordance with the printing data.

Further, the memory 62 stores a program that controls the following operations: the current carrying control to the heating elements of the thermal head 6 at least during printing on the basis of the printing data; the contacting and detaching operation of the thermal head 6 to the platen 2; the drive control of the carriage 5; and the carrying operation of a printed paper by the paper feeding mechanism, etc.

And, in order to control the printing setting position in accordance with the printing modes, on the basis of advance measurement results of the printing drifts in an actual thermal transfer printer, the data is calculated and stored in the memory 62 whereby the quantity of reverse rotation of a paper feeding motor to carry the printed paper that is based on the difference of contact pressures of the thermal head 6 to the platen 2 and the start position of printing by the heating elements of the thermal head 6 are to be modified That is, the control means 60 are designed to control the printing setting position by controlling a position where the printed paper is set and a position where a current-carrying to the thermal head 6 is started. Further, as for the setting of a printing position in the shifting direction of the thermal head 6, the control means 60 may be configured to control the printing setting position by the CPU 61 controlling to add or delete a dummy dot space during the expansion of images when the printing data is inputted to the memory 62 of the control means 60 from a computer or the like.

The operation of the control means 60 in the thermal transfer printer of this embodiment will now be described.

First, on the basis of a printing signal inputted from an external device, printing is conducted first with the thermally fused ink ribbon 43. In order to implement this, the position control of the cam 17 is executed so as to locate the pin 26 on the head pressing lever 25 at the first cam position 19*a* in the cam groove 19 for contacting and detaching the head. And, the printing is carried out by selectively controlling the current-carrying to the heating elements of the thermal head 6. Completing the printing for one line, the cam 17 is turned to maintain a state that the thermal head 6 is detached from the platen 2, and the carriage 5 is returned. Accompanied with this movement, the paper feeding motor is driven to perform a line feed operation for one scan. Then, the cam 17 is turned again, so that the thermal head 6 is pressed to the platen 2, and the following line is printed. When the repetition of the foregoing operations completes the printing for one page, the paper is reverse carried to the initial start position of printing.

Next, an overlapping printing using the thermally fused ink ribbon 43 of different color inks is effected by the repetition of the same printing operation as the one mentioned above.

And, when the printing with the thermally fused ink ribbon 43 is completed, printing by a lower contact pressure than the initial printing is carried out with the metallic ink ribbon 43. Here, in order to make the contact pressure of the thermal head 6 to the platen 2 suitable for the metallic ink ribbon 43, the amount of rotation of the motor 14 is controlled so as to locate the pin 26 on the head pressing lever 25 at the second cam position 19*b* in the cam groove 19 for contacting and detaching the head of the cam 17.

Since the contact pressure of the thermal head 6 to the platen 2 in this state is slightly lower than the contact pressure in the printing with the thermally fused ink ribbon 43, the thermal head 6 is located at a downward shifted position against the printed paper. Therefore, the control unit 60 controls to reduce the amount of return of the paper by the paper feeding motor just for the amount of this shift-down. Thereby, the drift of the printing position will not be created in the vertical direction, namely, the paper feeding direction, and the printing position becomes coincident with the initial printing position by the thermally fused ink ribbon.

And, also as for the printing in the lateral direction, namely, the moving direction of the thermal head 6, the ink transfer position of the ink ribbon is drifted, and the printing position will necessarily be drifted with the condition as it is. Accordingly, when expanding the printing information from a computer or the like as the printing data, the CPU 61 processes the printing data to correct the amount of the drift, and the corrected data is stored in the memory 62 of the control means 60.

Concretely, by adjusting the initial printing number of dummy dots in the memory, the start position of a real printing at which the current-carrying to the heating elements of the thermal head 6 is started is made to be modified on the basis of the printing data. That is, in the case of the high contact pressure of the thermal head 6 to the platen 2, the transfer position of the ink ribbon 43 is displaced toward the downstream in the moving direction of the thermal head 6, compared with the low contact pressure. Therefore, in the low contact pressure, the drift is made to be adjusted by increasing the initial number of the dummy dots. Further, the drift owing to the difference of contact pressures of the thermal head 6 to the platen 2 is, as mentioned above, measured in advance using an actual thermal transfer printer, and the measured data are stored in the memory 62. Using the data, the drift of the printing position in the vertical direction and lateral direction that is caused by the switching of the contact pressures is corrected through the modification of the amount of paper feed, or the method of expanding the printing data into images.

FIG. 2 is a typical presentation of this correction method. According to FIG. 2, the drift becomes significant in both the vertical direction and lateral direction, in the case of the printing by the high contact pressure and the printing by the low contact pressure conducted at the same position, and the amount of correction in that case have to be increased accordingly.

As described above, the method of this embodiment corrects the drift of the printing position due to the difference of contact pressures, so that even printing executed at one and the same printing position with plural kinds of ink with a plurality of contact pressures will not create drifts of printing, which will produce an excellent printed result.

Further, the invention is not limited to the aforementioned embodiment, and various changes and modifications are possible. For example, in the correction of the drift of the printing position due to the difference of contact pressures of the thermal head to the platen, the drift in the vertical direction, namely, the feeding direction of the printed medium can be corrected by expanding the upper data as the dummy dots during the expansion of image data, in the same manner as in the lateral, moving direction of the thermal head.

As the embodiment being thus described, the thermal transfer printer of the present invention displays the effect that produces a good printed result without creating displacement of printing positions, when performing printing on a printed medium in different printing modes, with different contact pressures of the thermal head to the platen.

What is claimed is:

1. A thermal transfer printer comprising:

a carriage that freely reciprocates along a platen;

a thermal head mounted on said carriage;

a head up-down mechanism that brings said thermal head into contact with said platen, and detaches it from said platen;

a carriage moving mechanism that reciprocates said carriage, whereby said thermal transfer printer executes printing on a printing medium with said thermal head pressed to said platen, while moving said carriage and driving said thermal head; and control means, for controlling a plurality of printing modes, that select a contact pressure of said thermal head to said platen in correspondence with a selected printing mode, and control a printing setting position by controlling a dummy dot space corresponding to an electrical energization starting position for said thermal head at the time of image development of said printing data in accordance with said selected printing mode, when the printing is carried out on the same sheet under a plurality of printing modes, to correct a displacement of the printing position in response to a variation in the contact pressure to said platen as said printing mode is selected.

2. The thermal transfer printer according to claim 1, wherein said control means include a central processing unit (CPU) that controls adding or deleting said dummy dot space when the inputted printing data image is developed in response to a difference in the contact pressure of said thermal head to said platen generated in correspondence with said selected printing mode.

* * * * *